United States Patent [19]

Baker

[11] Patent Number: 4,974,293

[45] Date of Patent: Dec. 4, 1990

[54] APPARATUS FOR CLEANING COTTON

[75] Inventor: Roy V. Baker, Lubbock, Tex.

[73] Assignee: The United States of America as represented by the Secretary of Agriculture, Washington, D.C.

[21] Appl. No.: 450,109

[22] Filed: Dec. 13, 1989

[51] Int. Cl.[5] ..... D01B 1/08

[52] U.S. Cl. ..... 19/40; 19/37

[58] Field of Search ..... 19/35–45

[56] References Cited

U.S. PATENT DOCUMENTS

| | | | |
|---|---|---|---|
| 427,925 | 5/1890 | Spangenberg | 19/41 |
| 530,533 | 12/1894 | Johnson | 19/40 |
| 601,169 | 3/1898 | Ragsdale | 19/41 |
| 904,939 | 11/1908 | Crowson | 19/39 |
| 1,139,345 | 5/1915 | Conrad | 19/37 |
| 1,215,260 | 2/1917 | Dunlap | 19/39 |
| 1,216,673 | 2/1917 | Ellenburg | 19/38 |
| 1,304,804 | 5/1919 | Purnell et al. | 19/38 |
| 1,766,312 | 4/1928 | Smith | 19/36 |
| 2,733,480 | 2/1956 | Mitchell | 19/37 |
| 2,902,722 | 9/1959 | Wallace | 19/37 |

FOREIGN PATENT DOCUMENTS

| | | | |
|---|---|---|---|
| 0910867 | 7/1977 | U.S.S.R. | 19/40 |
| 1087569 | 3/1982 | U.S.S.R. | 19/40 |
| 1227723 | 4/1986 | U.S.S.R. | 19/40 |
| 7585 | of 1869 | United Kingdom | 19/41 |

*Primary Examiner*—Werner H. Schroeder
*Assistant Examiner*—John J. Calvert
*Attorney, Agent, or Firm*—M. Howard Silverstein; John D. Fado

[57] ABSTRACT

Apparatus for removing foreign matter from cotton comprising a plurality of extractor cylinders in series, and a plurality of reclaimer cylinders in parallel, one for each of the extractor cylinders, wherein the first reclaimer cylinder directs reclaimed cotton to the second extractor cylinder in the series.

11 Claims, 3 Drawing Sheets

FIG.3
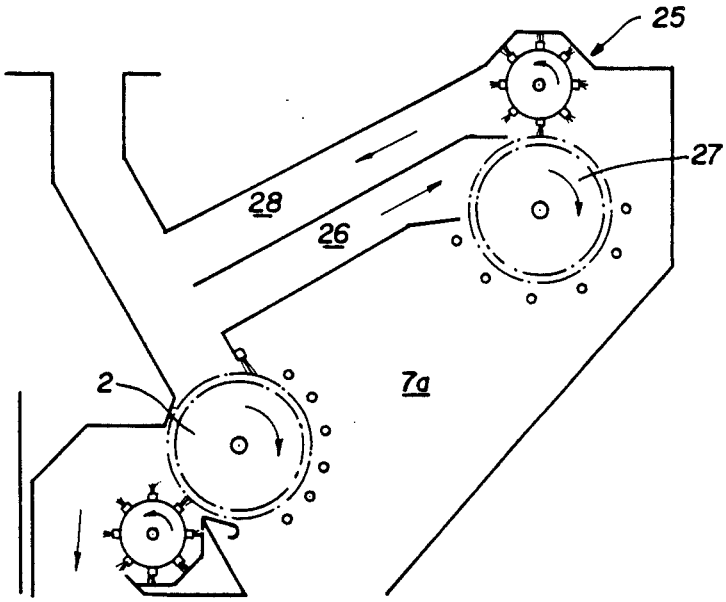
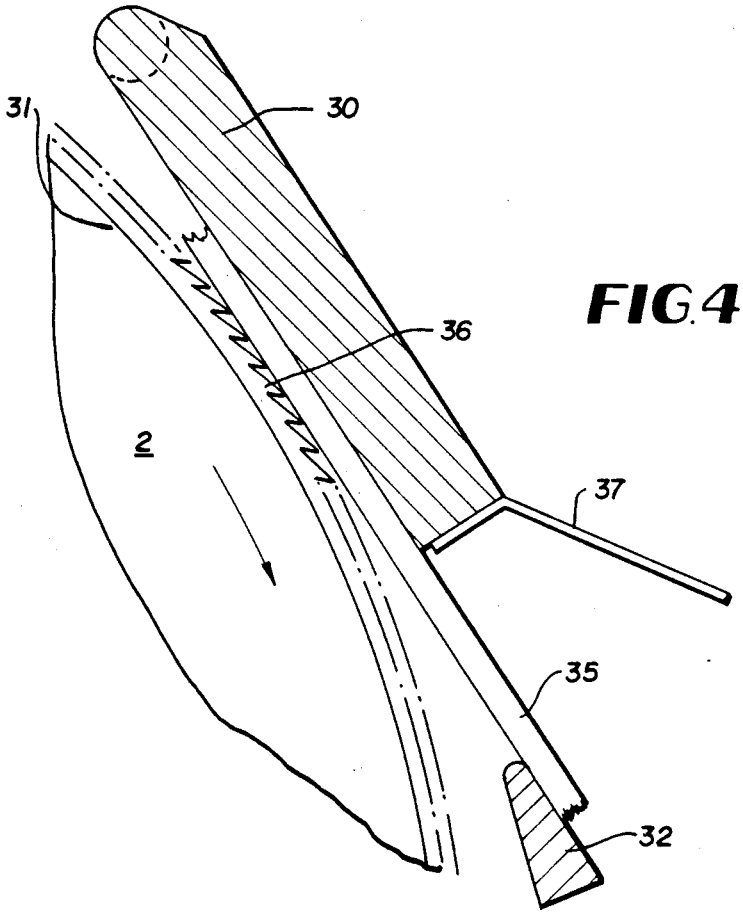
FIG.4

APPARATUS FOR CLEANING COTTON

FIELD

This invention relates to cleaning cotton, in particular to removing cotton burs, plant sticks and stems, and finely divided foreign matter from seed cotton.

PRIOR ART

Extractor cylinders (sometimes referred to as extracting or extractor saw cylinders) and reclaiming cylinders (sometimes referred to as reclaimer or reclaimer saw cylinders) are well known in the cotton cleaning art, as exemplified by U.S. Pat. Nos. 2,580,451, 2,739,353, 2,776,454, 2,836,856, 2,902,722, 2,898,636.

SUMMARY

I now have developed a unique multi-stage system of extractor cylinders and reclaiming cylinders that eliminates the necessity of having a plurality of extractor cylinder assemblies at diverse locations in a ginning system. The multi-stage system of the present invention combines all of a gin's extraction functions into a single machine that may be located early in the gin's seed cotton cleaning system.

Broadly, the invention comprises:

at least first and second extractor cylinders; means to feed cleaned cotton from the first to the stored; a plurality of reclaimer cylinders that cooperate with said extractor cylinders so that foreign matter exiting from said first extractor cylinder is fed to a different reclaimer cylinder than the one cooperating with said second extractor cylinder; means to feed reclaimed cotton to said second extractor cylinder from the reclaimer cylinder that cooperates with said first extractor cylinder; and means to combine foreign matter exiting from each of said reclaimer cylinders.

More specifically, the invention comprises a. inlet means to receive cotton that contains foreign matter;

b. first extracting cylinder means connected to the inlet means to separate the cotton into a first cleaned cotton fraction and a first foreign matter fraction;

c. second extracting cylinder means connected to the first extracting cylinder means to receive the first cleaned cotton fraction and separate it into a second cleaned cotton fraction and a second foreign matter fraction;

e. cotton outlet means connected to the second extracting cylinder means to receive cleaned cotton;

f. first reclaiming cylinder means connected to the first extracting cylinder means to receive the first foreign matter fraction and separate it into a first reclaimed cotton fraction and a first disposable foreign matter fraction;

g. second reclaiming cylinder means connected to the second extracting cylinder means to receive the second foreign matter fraction and separate it a second reclaimed cotton fraction and a second disposable foreign matter fraction;

h. means connected to the first reclaiming cylinder means to direct the first reclaimed cotton fraction to join with the first cleaned cotton fraction;

i. means connected to the second reclaiming cylinder means to direct the second reclaimed cotton fraction to join with cleaned cotton upstream from the cotton outlet;

j. foreign matter outlet means connected to the first and second reclaiming cylinder means to receive the first and second disposable foreign matter fractions.

In addition, the invention provides an overflow device to receive overflow cotton that is unable to enter the first extracting cylinder, to partly clean the overflow cotton in an auxiliary extractor cylinder, and to direct the partly cleaned cotton back to the first extractor cylinder.

Also, the invention provides a self-adjustable open window in close proximity to a surface of an extractor cylinder to permit egress of sticks which are embedded in cotton on the surface but which have leading free ends in the direction of cylinder rotation.

Therefore, it is an object of the present invention to provide an extraction system that is completed before the cotton passes through the entire cleaning and drying system.

Another object is to produce cleaner seed cotton than that normally obtained with conventional gin machinery.

A further object is to permit more efficient lint/seed separation at the gin stand, and reduce the cleaning requirements of the fiber after ginning.

A still further object is to reduce ginning costs and damage to fibers.

Still another object is to reduce the amount of foreign material, at an early stage, that might otherwise be broken up during subsequent handling.

Yet a further object is to provide for the early removal of large pieces of foreign matter so as to minimize the formation of finely divided foreign material or bark strands or slivers created by the crushing and breaking of such large pieces in prior art extraction systems.

An additional object is to lessen the degree of entanglement between foreign matter and cotton by providing for early removal of such matter.

A yet further object is to provide improved cleaning performance, e.g., 92% cleaning efficiency in comparision to 84% efficiency in a prior art system employing two individual extractors and two parallel seed cotton deliveries, one for each extractor.

An even yet further object is to provide improved flow uniformity, which leads to better extraction efficiency and lower cotton losses. In the prior art, wherein extraction is carried out at a plurality of locations, such uniformity is difficult to achieve.

Still an additional object is to provide a system that is able to handle present day processing rates. Prior art multi-stage devices do not have such capabilities.

Other objects and advantages will be obvious from the following more detailed description of the invention, in conjunction with the drawings in which:

FIGS. 3 and 4 depict optional equipment.

DETAILED DESCRIPTION

Figure 1:
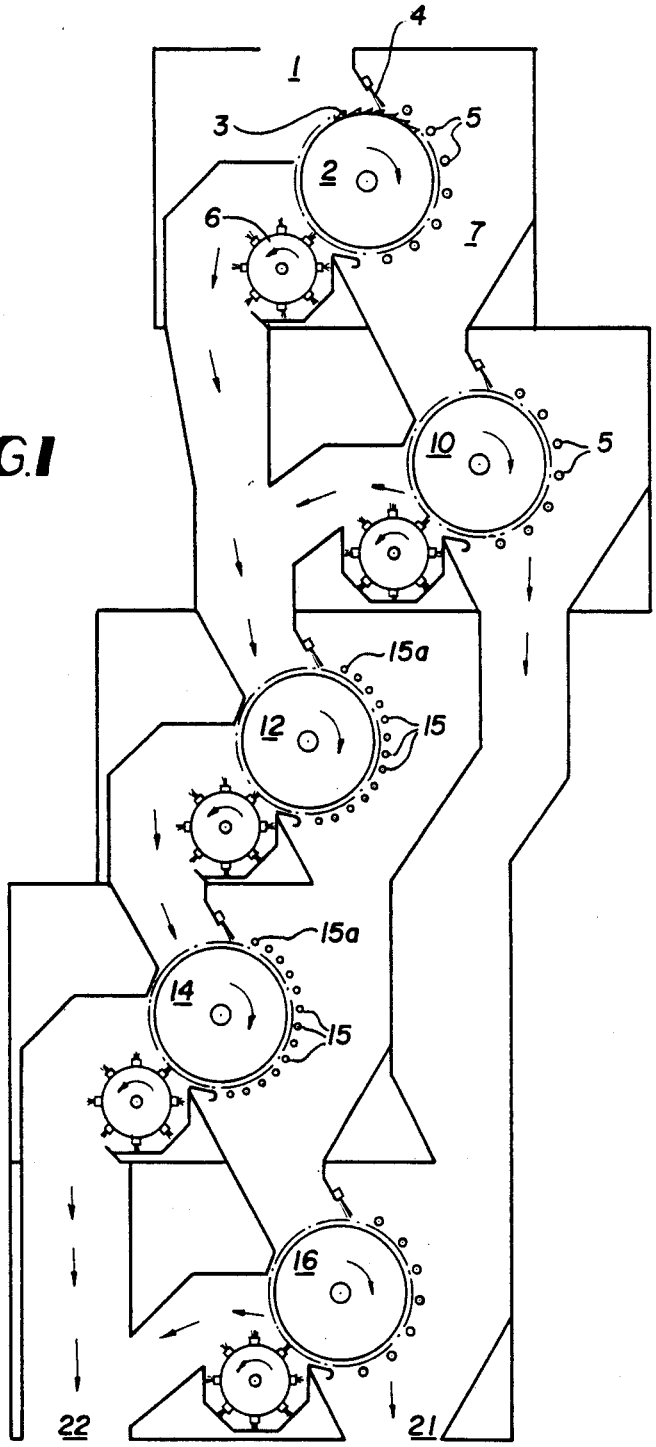
FIG. 1 illustrates the basic machine of the present invention.

In the multi-stage apparatus of the present invention, seed cotton may be fed into the device's entrance 1 by gravity flow from a seed cotton air separator/vacuum dropper, inclined cylinder head, or similar device (none shown). The cotton falls directly onto the top portion of a toothed primary extractor cylinder 2 having toothed projections 3 to engage the cotton fibers and cause the cotton to follow the rotating cylinder.

A stationary brush 4 near the top of the cylinder aids in bringing the cotton into contact with the cylinder. The rotation of the cylinder creates centrifugal forces that cause foreign material or matter to separate from the seed cotton.

Grid bars 5 located about the periphery of a portion of the cylinder aid the separation process and help prevent excessive loss of cotton.

A rotating doffing brush cylinder 6 removes cotton from the toothed cylinder at a point beyond the foreign material separation zone 7.

The extracted foreign material and the cotton lost in the process is directed to the first reclaiming cylinder 10 for the purpose of reclaiming the cotton from the foreign material. The reclaimed cotton then is merged with the cotton from the primary clinder 2, and the total mass of cotton then is directed to the second primary extraction cylinder 12.

Cotton doffed from the cylinder 12 is directed to a third primary extraction cylinder 14 for final foreign matter separation.

Cylinders 12 and 14 are similar in design to cylinder 2, but grid bars 15 thereabout are different than grid bars 5. In particular, grid bars 15 are smaller in size and spaced close together than grid bars 5 to enhance the extraction process for once-extracted cotton, and to reduce the amount of cotton lost by extraction cylinders 12 and 14. The uppermost gird bar 15*a*, i.e., the bar closest to the stationary brush, may be slightly larger than the other grid bars 15. With such a grid design, only one reclaimer cylinder 16 may be required to recover cotton lost by both cylinders 12 and 14.

Foreign material separated by reclaimer cylinders 10 and 16 is discarded through lower outlet 21. Reclaimed cotton from the second reclaimer cylinder is merged with the main cotton flow from the third primary extractor cylinder. All cotton then exits the machine through passage 22, and is fed into the gin's existing cotton handling system.

Exemplary dimensions and operating conditions are as follows:

- cylinders 2, 10, 12, 14, 16: 16-inch diameter channel saw, 350 rpm;
- grid bars 5: 7 each, 1-inch diameter, spaced apart 21.5°, set to clear saw by 0.5 inch;
- grid bars 15: 12 each, 0.25-inch diameter, spaced apart 12°, set to clear saw by 0.5 inch;
- grid bar 15*a*: 0.625-inch diameter, spaced 16° from stationary brush, set to clear saw by 0.5 inch.

Dimensions, grid spacing, and operating conditions obviously will vary depending upon such factors as the source of the cotton, the size of the foreign matter therein, and the capacity of the ginning system.

While the grid bars may be circular in cross section, other shapes may be employed.

Bypass valves and passages may be provided at the entrance to each extractor cylinder to bypass a portion of the machine when processing cotton that does not require the full complement of extractor cylinders.

Figure 2:
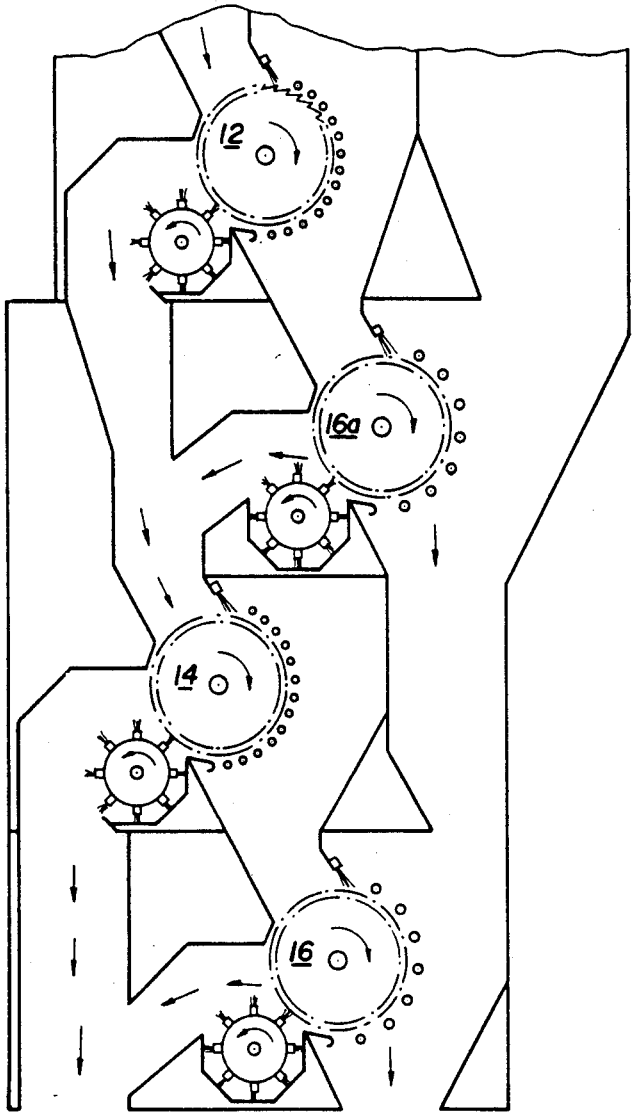
FIG. 2 is an alternative embodiment.

As an alternative embodiment, separate reclaiming cylinders 16*a* and 16 may be provided for each of the second and third extracting cylinders 12 and 14, as shown in FIG. 2.

Referring not to FIG. 3, therein is shown an optional cotton overflow device 25 adjacent extractor cylinder 2. The overflow device includes a first passage 26 to receive overflow cotton that is unable to enter cylinder 2. Passage 26 directs the overflow to an auxiliary extractor cylinder 27. Partly cleaned cotton from cylinder 27 is directed back to cylinder 2 by means of passage 28. Foreign matter and lost cotton from cylinder 27 travels through passage 7*a* to the first reclaimer cylinder 10 (not shown in FIG. 3).

FIG. 4 illustrates an optional attachment for the extractor cylinders to aid in the removal of sticks. Many sticks, if not thrown off early by an extractor cylinder, may become oriented in a position more or less parallel to the flow of cotton around the extractor saw, with the free ends of the sticks in the lead, and the trailing ends embedded in the cotton, as if the sticks are being pushed around the saw by the trailing ends.

To take advantage of this orientation, a spring-loaded guide 30 and an adjacent fixed blunt-nosed member or bar 32 together define a self-adjustable open window in close proximity to surface 31 of, for example, the first extractor cylinder 2 to permit egress of sticks 35 which are embedded in cotton on the surface but which have leading free ends in the direction of cylinder rotation. The size and position of the window are such that members 30 and 32 both engage the sticks passing therebetween, but do not provide resistant to passage.

Guide 30 not only functions to help define the self-adjustable window, but also acts to guide the leading free ends of the sticks into the window opening as the cylinder rotates past the window. As can be appreciated, the width of the window should be about the same as the length of the cylinder; and the plane of the window is parallel to the axis of the cylinder.

Tension on guide 30 preferably is adjusted to keep sticks which engage the guide to become or remain generally tangent to the cylinder, and thereby to prevent contact with the saw, until the sticks actually are trapped between the guide 30 and bar 32, or, in other words, until the sticks are within the window defined by guide 30 and bar 32. However, tension on guide 30 should not be so great that large wads of foreign matter will be restrained by the guide and pushed back into the saw 36.

A tail flap 37 is attached to the downstream end of guide 30 to prevent sticks from turning around and re-entering the cotton after the sticks' trailing ends disengage from the cotton and are able to leave the confines of the window.

I claim:

1. Apparatus for removing foreign matter from cotton comprising at least first and second extractor cylinders; means to feed cleaned cotton from the first to the second; a plurality of reclaimer cylinders that cooperate with said extractor cylinders so that foreign matter exiting from said first extractor cylinder is fed to a different reclaimer cylinder than the one cooperating with said second extractor cylinder; means to feed reclaimed cotton to said second extractor cylinder's cleaned cotton feeding means from the reclaimer cylinder that cooperates with said first extractor cylinder; and means to combine foreign matter exiting from each of said reclaimer cylinders.

2. Apparatus for removing foreign matter from cotton comprising at least first and second extractor cylinders; means to feed cleaned cotton from the first to the second; a plurality of reclaimer cylinders that cooperate with said extractor cylinders so that foreign matter exiting from said first extractor cylinder is fed to a different reclaimer cylinder than the one cooperating with said second extractor cylinder; means to feed reclaimed cotton to said second extractor cylinder from the reclaimer cylinder that cooperates with said first extractor cylinder; means to combine foreign matter exiting from each of said reclaimer cylinders; cotton overflow means adjacent said first extractor cylinder to receive overflow cotton that is unable to enter said first extractor cylinder; wherein said overflow means comprises an auxiliary extractor cylinder to separate said overflow cotton into partly cleaned cotton and foreign matter, means connected to said overflow means to direct said partly cleaned cotton back to said first extractor cylinder; and means connected to said overflow means to direct said foreign matter to the reclaimer cylinder that cooperates with said first extractor cylinder.

3. Apparatus for removing foreign matter from cotton comprising at least first and second extractor cylinders; means to feed cleaned cotton from the first to the second; a plurality of reclaimer cylinders that cooperate with said extractor cylinders so that foreign matter exiting from said first extractor cylinder is fed to a different reclaimer cylinder than the one cooperating with said second extractor cylinder; means to feed reclaimed cotton to said second extractor cylinder from the reclaimer cylinder that cooperates with said first extractor cylinder; means to combine foreign matter exiting from each of said reclaimer cylinders; means defining a self-adjustable window in close proximity to a surface of at least one of said extractor cylinders to permit egress of sticks which are embedded in cotton on said surface but which have leading free ends in the direction of cylinder rotation; wherein said window-defining means includes means to guide said leading free ends into said window as said free ends approach said window.

4. Apparatus for removing foreign matter from cotton comprising first, second and third extractor cylinders; means to feed cleaned cotton from the first to the second; a plurality of reclaimer cylinders that cooperate with said extractor cylinders so that foreign matter exiting from said first extractor cylinder is fed to a different reclaimer cylinder than the one cooperating with said second extractor cylinder; means to feed reclaimed cotton to said second extractor cylinder from the reclaimer cylinder that cooperates with said first extractor cylinder; means to combine foreign matter exiting from each of said reclaimer cylinders; means for feeding foreign matter exiting from said second and third extractor cylinders to the same reclaimer clyinder; and means to combine cotton exiting from said third extractor cylinder with reclaimed cotton exiting from the reclaimner cylinder cooperating with said second and third extractors.

5. The apparatus of claim 4 wherein wherein each extractor cylinder includes a grid separator, and wherein said first extractor cylinder includes a grid separator that provides for passage of larger foreign matter than the grid separator for said second and third extractor cylinders.

6. Apparatus for removing foreign matter from cotton comprising a. inlet means to recieve cotton that contains foreign matters;

b. first extracting cylinder means connected to said inlet means to separate said cotton into a first cleaned cotton fraction and a first foreign matter fraction;

c. second extracting cylinder means connected to said first extracting cylinder means to receive said first cleaned cotton fraction and separate it into a second cleaned cotton fraction and a second foreign matter fraction;

e. cotton outlet means connected to said second extracting cylinder means to receive cleaned cotton;

f. first reclaiming cylinder means connected to said first extracting cylinder meand to receive said first foreign matter fraction and separate it into a first reclaimed cotton fraction and a first disposable foreign matter fraction;

g. second reclaiming cylinder means connected to said second extracting cylinder means to receive said second foreign matter fraction and separate it a second reclaimed cotton fraction and a second disposable foreign matter function;

h. means connected to said first reclaiming cylinder means to direct said first reclaimed cotton fraction to join with said first cleaned cotton fraction;

i. means connected to said second reclaiming cylinder means to direct said second reclaimed cotton fraction to join with cleaned cotton upstream from said cotton outlet;

j. foreign matter outlet means connected to said first and second reclaiming cylinder means to receive said first and second disposable foreign matter fractions.

7. The apparatus of claim 6 further including third extracting cylinder means connected to said second extracting cylinder means to receive said second cleaned cotton fraction and separate it into a third cleaned cotton fraction and a third foreign matter fraction; means connected to said third extracting cylinder means to direct said third cleaned cotton fraction to said cotton outlet; means connected to said third extracting cylinder to direct said third foreign matter fraction to said second reclaiming cylinder.

8. The apparatus of claim 7 wherein said second reclaiming cylinder means comprises two separate reclaiming cylinders, one for each of said second and third extracting cylinder means.

9. The apparatus of claim 7 wherein each of said extracting cylinder means includes grid separator means through which foreign matter is able to pass; and wherein said grid separator means for said first extractng cylinder means permits the passage of larger foreign matter than said grid separator means for said second and third extracting cylinder means.

10. The apparatus of claims 6, 7, 8, or 9 further including cotton overflow means adjacent said first extracting cylinder means to receive overflow cotton that is unable to enter said first extracting cylinder means; wherein said overflow means comprises auxiliary extracting cylinder means to separate said overflow cotton into partly cleaned cotton and foreign matter, means connected to said overflow means to direct said partly cleaned cotton back to said first extracting cylinder means; and means connected to said overflow means to direct said foreign matter to said first reclaiming cylinder means.

11. The apparatus of claims 6, 7, 8, or 9 further including means defining a self-adjustable window in close proximity to a surface of at least one of said extracting cylinder means to permit egress of sticks which are embedded in cotton on said surface but which have leading free ends in the direction of cylinder rotation; wherein said window-defining means includes means to guide said leading free ends into said window as said free ends approach said window.

* * * * *